US008981659B2

(12) United States Patent
Kim et al.

(10) Patent No.: US 8,981,659 B2
(45) Date of Patent: Mar. 17, 2015

(54) INPUT VOLTAGE TRANSFER APPARATUS FOR LIGHT EMITTING DIODE LIGHTING SYSTEM

(75) Inventors: Young Jong Kim, Seoul (KR); Sang Hyun Park, Seoul (KR); Sang Man Kim, Seoul (KR); Woo Chang Jung, Seoul (KR); Gwan Bon Koo, Seoul (KR); Dong Young Huh, Seoul (KR); Seok Yoon, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 14/005,883

(22) PCT Filed: Oct. 10, 2011

(86) PCT No.: PCT/KR2011/007490

§ 371 (c)(1),
(2), (4) Date: Feb. 22, 2014

(87) PCT Pub. No.: WO2012/128436

PCT Pub. Date: Sep. 27, 2012

(65) Prior Publication Data

US 2014/0217925 A1 Aug. 7, 2014

(30) Foreign Application Priority Data

Mar. 18, 2011 (KR) ..... 10-2011-0024492

(51) Int. Cl.
*H05B 33/08* (2006.01)

(52) U.S. Cl.
CPC ..... *H05B 33/0815* (2013.01)
USPC ..... 315/224; 315/291; 315/307

(58) Field of Classification Search
USPC ..... 315/224, 291, 307, 308, 209 R
See application file for complete search history.

(56) References Cited

U.S. PATENT DOCUMENTS 8,575,849 B2 * 11/2013 Simi ..... 315/219
2004/0207337 A1 10/2004 Fischer et al.

(Continued)

FOREIGN PATENT DOCUMENTS

CN 101227778 A 7/2008
CN 201414240 Y 2/2010

(Continued)

OTHER PUBLICATIONS

Taiwan Office action for Taiwan Patent Application No. 101109013 which corresponds to the above-identified U.S. application, May 26, 2014.

(Continued)

*Primary Examiner* — David H Vu
(74) *Attorney, Agent, or Firm* — LRK Patent Law Firm

(57) ABSTRACT

An input voltage transfer apparatus for an LED lighting system is provided. The input voltage transfer apparatus includes a source voltage storage unit, a zero voltage switching unit, and a nonzero voltage switching unit. The source voltage storage unit stores a source voltage. The zero voltage switching unit turns on according to the source voltage stored in the source voltage storage unit when a zero voltage is inputted. The nonzero voltage switching unit turns on according to a current applied thereto through the zero voltage switching unit when a nonzero voltage is inputted. When the nonzero voltage switching unit is turned on, the source voltage storage unit discharges the stored source voltage.

20 Claims, 2 Drawing Sheets

(56) References Cited

U.S. PATENT DOCUMENTS

| | | | | |
|---|---|---|---|---|
| 2008/0258647 | A1 | 10/2008 | Scianna | |
| 2009/0184668 | A1* | 7/2009 | Mednik et al. | 315/297 |
| 2010/0013405 | A1 | 1/2010 | Thompson et al. | |
| 2010/0090618 | A1 | 4/2010 | Veltman | |
| 2011/0043121 | A1 | 2/2011 | Matsuda et al. | |
| 2012/0056553 | A1 | 3/2012 | Koolen et al. | |

FOREIGN PATENT DOCUMENTS

| | | | |
|---|---|---|---|
| CN | 102223749 | A | 10/2011 |
| JP | 2001-016804 | A | 1/2001 |
| JP | 2002-354790 | A | 12/2002 |
| JP | 3630019 | B2 | 3/2005 |
| JP | 2006-319172 | A | 11/2006 |
| JP | 2011-048978 | A | 3/2011 |
| KR | 10-0877521 | B1 | 1/2009 |
| KR | 10-2011-0027328 | A | 3/2011 |
| TW | 201010497 | A | 3/2010 |

OTHER PUBLICATIONS

European search report for European Patent Application No. 11861770 which corresponds to the above-identified U.S. application, Aug. 5, 2014.

Chinese Office action for Chinese Patent Application No. 201180070243.7 which corresponds to the above-identified U.S. application, Jul. 28, 2014.

International Search Report for International Application No. PCT/KR2011/007490, Aug. 5, 2014.

* cited by examiner

INPUT VOLTAGE TRANSFER APPARATUS FOR LIGHT EMITTING DIODE LIGHTING SYSTEM

TECHNICAL FIELD

The present disclosure relates to an input voltage transfer apparatus for a Light Emitting Diode (LED) lighting system.

BACKGROUND ART

Generally, since LEDs are semiconductor devices, LEDs have long service life, fast lighting speed, low consumption power, and excellent color reproductivity.

Moreover, LEDs are robust to impact, and it is easy to miniaturize and thin LEDs.

Therefore, lighting systems with LEDs are recently being introduced, and research is continuously being conducted on an LED lighting system that more effectively controls the amount of a current supplied to LEDs.

DISCLOSURE OF INVENTION

Technical Problem

Embodiments provide an input voltage transfer apparatus for an LED lighting system, which turns on a switching element when a zero voltage is inputted as an input voltage, turns on a separate switching element when a non-zero voltage is inputted in a state where the switching element is being turned on, turns on the switching element, which has been turned on when the zero voltage is inputted, for a certain time, and thus can efficiently maintain dimming and prevent flicker from occurring in an LED.

Solution to Problem

In one embodiment, an input voltage transfer apparatus for an LED lighting system includes: a source voltage storage unit storing a source voltage; a zero voltage switching unit turning on according to the source voltage stored in the source voltage storage unit when a zero voltage is inputted; and a nonzero voltage switching unit turning on according to a current applied thereto through the zero voltage switching unit when a nonzero voltage is inputted, wherein when the nonzero voltage switching unit is turned on, the source voltage storage unit discharges the stored source voltage.

In another embodiment, an input voltage transfer apparatus for an LED lighting system includes: a source voltage storage unit storing a source voltage; a zero voltage switching unit turning on according to the source voltage stored in the source voltage storage unit when a zero voltage is inputted; a shutdown signal supply unit receiving the source voltage to supply a shutdown signal for shutting down a control circuit, when the zero voltage is inputted thereto; and a nonzero voltage switching unit turning on according to a current applied thereto through the zero voltage switching unit when a nonzero voltage is inputted, wherein when the nonzero voltage switching unit is turned on, the shutdown signal supply unit is turned off, and the source voltage storage unit discharges the stored source voltage.

Advantageous Effects of Invention

The input voltage transfer apparatus for an LED lighting system, according to the embodiments, turns on a switching element when a zero voltage is inputted as an input voltage, turns on a separate switching element when a non-zero voltage is inputted in a state where the switching element is being turned on, turns on the switching element, which has been turned on when the zero voltage is inputted, for a certain time, and thus can efficiently maintain dimming and prevent flicker from occurring in an LED.

MODE FOR THE INVENTION

Figure 1:
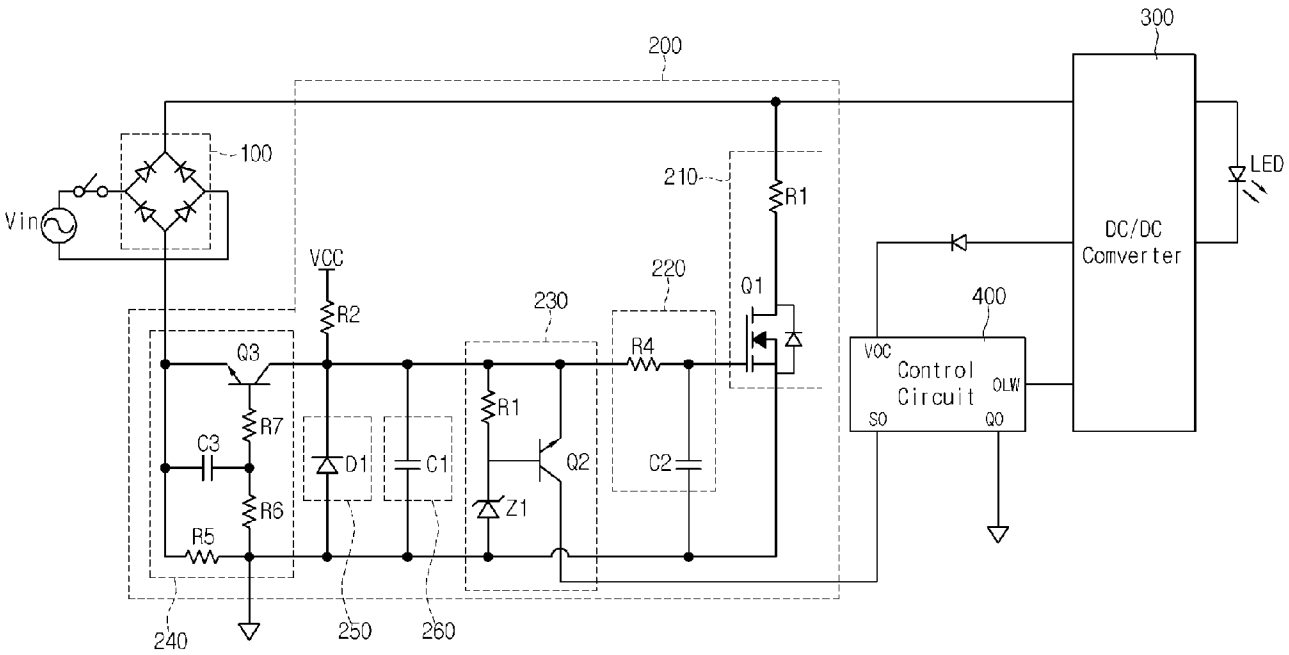
FIG. 1 is a circuit diagram illustrating an input voltage transfer apparatus for an LED lighting system, according to an embodiment.

Hereinafter, exemplary embodiments of the inventive concept will be described in detail with reference to the accompanying drawings. In adding reference numerals for elements in each figure, it should be noted that like reference numerals already used to denote like elements in other figures are used for elements wherever possible. Moreover, detailed descriptions related to well-known functions or configurations will be ruled out in order not to unnecessarily obscure subject matters of the present invention.

Figure 2:
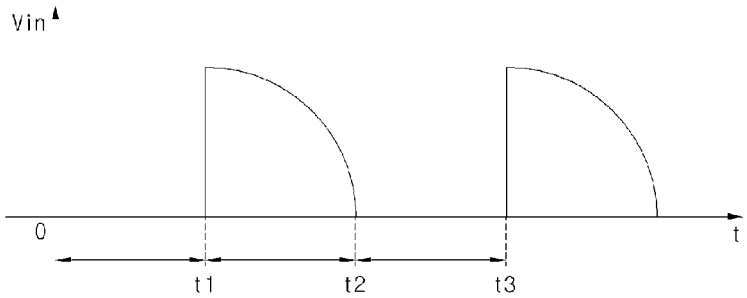
FIG. 2 is a diagram showing a waveform of an input voltage which is inputted to an input voltage transfer apparatus for an LED lighting system according to an embodiment.
Figure 3:
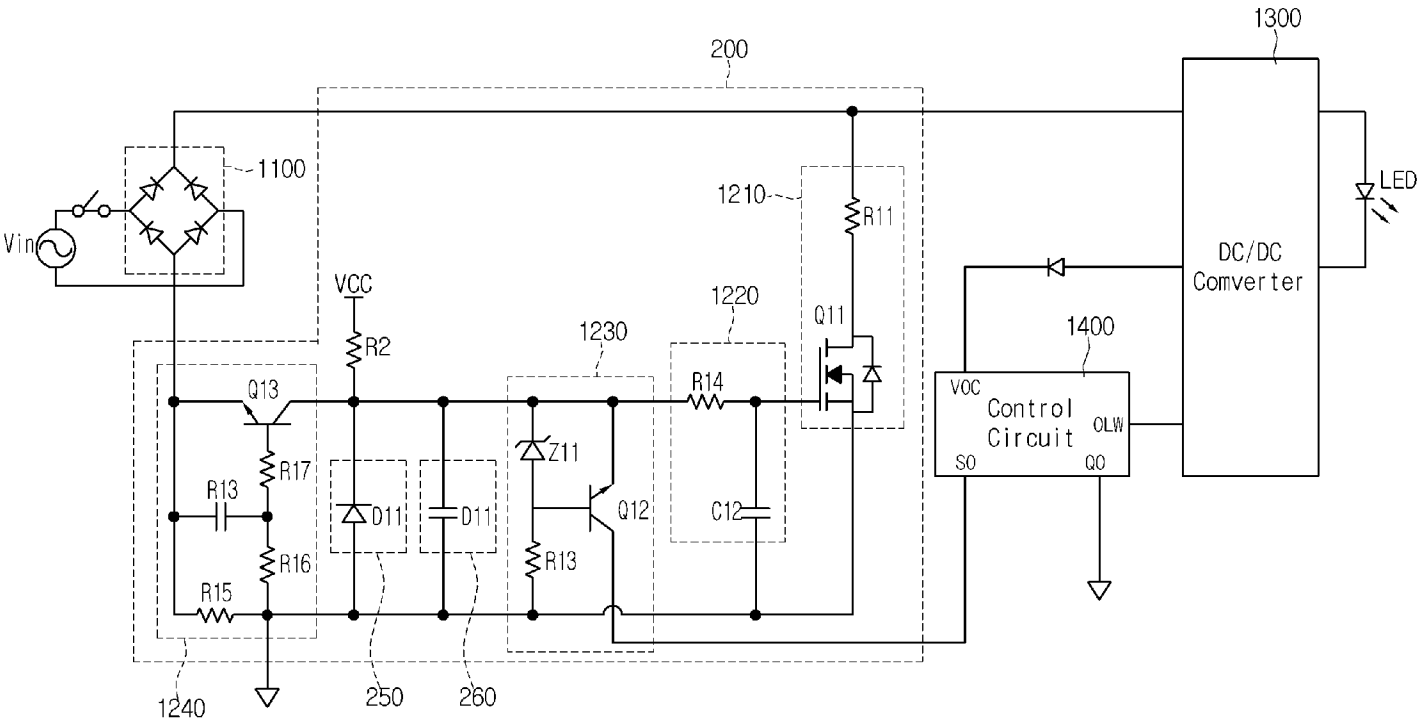
FIG. 3 is a circuit diagram illustrating a modification example of an input voltage transfer apparatus for an LED lighting system according to an embodiment.

FIG. 1 is a circuit diagram illustrating an input voltage transfer apparatus for an LED lighting system, according to an embodiment. FIG. 2 is a diagram showing a waveform of an input voltage which is inputted to an input voltage transfer apparatus for an LED lighting system according to an embodiment. FIG. 3 is a circuit diagram illustrating a modification example of an input voltage transfer apparatus for an LED lighting system according to an embodiment.

Referring to FIG. 1, an input voltage transfer apparatus 200 for an LED lighting system, according to an embodiment, may include a source voltage storage unit 220, a zero voltage switching unit 210, a shutdown signal supply unit 230, and a nonzero voltage switching unit 240.

The source voltage storage unit 220 stores a source voltage VCC transferred through a resistor R2, in which state the source voltage storage unit 220 discharges the stored source voltage VCC when the nonzero voltage switching unit 240 is turned on. Herein, the source voltage storage unit 220 includes a first resistor R4 and a first capacitor C2. The resistor R2 transfers the source voltage VCC to the source voltage storage unit 220.

The zero voltage switching unit 210 is turned on when a zero voltage is inputted through a bridge circuit 100 (Vin during time t0-t1 in FIG. 2), but when a nonzero voltage is inputted through the bridge circuit 100 (Vin during time t1 t2 in FIG. 2), the zero voltage switching unit 210 applies a current to the nonzero voltage switching unit 240.

The zero voltage switching unit 210 includes an n-channel metal oxide semi-conductor (NMOS) transistor Q1 or an NPN bipolar junction transistor. The resistor R1 transfers an input voltage Vin.

As described above, when the nonzero voltage switching unit 240 is turned on, the source voltage storage unit 220 discharges a stored source voltage VCC, and thus, when a voltage stored in the first capacitor C2 is shifted to less than a threshold voltage of the NMOS transistor Q1, the zero voltage switching unit 210 is turned off.

Therefore, when the nonzero voltage is inputted, a turned-off time of the zero voltage switching unit 210 may be adjusted by regulating a time constant R4*C2 of the source voltage storage unit 220. That is, even when the zero voltage is inputted and then the nonzero voltage is inputted, the zero voltage switching unit 210 is not turned off but is turned on proportional to the time constant R4*C2 and then turned off. Accordingly, even when the zero voltage is inputted and then the nonzero voltage is inputted, the zero voltage switching unit 210 and the nonzero voltage switching unit 240 are simultaneously turned on during the time constant R4*C2 thereby applying a current.

The shutdown signal supply unit 230 is turned on by the source voltage VCC that is applied thereto when the zero voltage is inputted, and supplies a shutdown signal SD for shutting down a control circuit 400 to the control circuit 400. However, when the nonzero voltage switching unit 240 is turned on, the shutdown signal supply unit 230 is turned off and does no longer supply the shutdown signal SD.

The shutdown signal supply unit 230 may include a p-channel MOS (PMOS) transistor or a PNP bipolar junction transistor Q2. The shutdown signal supply unit 230 may further include a Zener diode Z1 connected between a base of the PNP bipolar junction transistor Q2 and a ground. A resistor R3 transfers the source voltage VCC.

When the nonzero voltage is inputted (Vin during time t1 t2 in FIG. 2), the nonzero voltage switching unit 240 is turned on by a current that is applied thereto through the zero voltage switching unit 210.

When the nonzero voltage switching unit 240 is turned on, the source voltage VCC is no longer applied to the source voltage storage unit 220 and the shutdown signal supply unit 230. Thus, the source voltage storage unit 220 discharges a stored source voltage VCC, and the shutdown signal supply unit 230 does not supply the shutdown signal SD.

The nonzero voltage switching unit 240 includes an NMOS transistor or an NPN bipolar junction transistor Q3. Resistors R5 to R7 transfer a current that is applied by the zero voltage switching unit 210. A capacitor C3 prevents a noise signal from being applied.

In the input voltage transfer apparatus 200, the zero voltage switching unit 210 is turned on when the zero voltage is inputted as the input voltage, and then when the nonzero voltage is inputted, the zero voltage switching unit 210 is not immediately turned off but is turned on proportional to the time constant R4*C2 and then turned off, thus more efficiently maintaining dimming.

Accordingly the input voltage transfer apparatus 200 can more efficiently maintain dimming, and thus prevent flicker from occurring in an LED.

The input voltage transfer apparatus 200 may further include a reverse-current prevention unit 250 that prevents a current from being reversely applied to the zero voltage switching unit 210. The reverse-current prevention unit 250 includes a diode D1 that has a cathode connected to a resistor, and an anode connected to the ground.

The input voltage transfer apparatus 200 may further include an auxiliary storage unit 260 that stores an applied source voltage VCC while the zero voltage is being inputted and then discharges the stored source voltage VCC while the nonzero voltage is being inputted. The auxiliary storage unit 260 includes a second capacitor C1.

A modification example 1200 of the input voltage transfer apparatus 200 according to an embodiment will be described below with reference to FIG. 3. In describing the modification example 1200, however, only a difference between the input voltage transfer apparatus 200 and the modification example 1200 will be described below.

Referring to FIG. 3, the modification example 1200 of the input voltage transfer apparatus 200 includes a shutdown signal supply unit 1230. The shutdown signal supply unit 1230 includes an NMOS transistor or an NPN bipolar junction transistor Q12. The shutdown signal supply unit 1230 may further include a Zener diode Z11 connected between a base of the NPN bipolar junction transistor Q12 and a resistor R12. A resistor R13 transfers the source voltage VCC.

As described above, the input voltage transfer apparatus for an LED lighting system, according to the embodiments, turns on a switching element when a zero voltage is inputted as an input voltage, turns on a separate switching element when a non-zero voltage is inputted in a state where the switching element is being turned on, turns on the switching element, which has been turned on when the zero voltage is inputted, for a certain time, and thus can efficiently maintain dimming and prevent flicker from occurring in an LED.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An input voltage transfer apparatus for a Light Emitting Diode (LED) lighting system, the input voltage transfer apparatus comprising:

a source voltage storage unit storing a source voltage;

a zero voltage switching unit turning on according to the source voltage stored in the source voltage storage unit when a zero voltage is inputted; and a nonzero voltage switching unit turning on according to a current applied thereto through the zero voltage switching unit when a nonzero voltage is inputted, wherein when the nonzero voltage switching unit is turned on, the source voltage storage unit discharges the stored source voltage.

2. The input voltage transfer apparatus according to claim 1, wherein the source voltage storage unit comprises a first resistor and a first capacitor.

3. The input voltage transfer apparatus according to claim 1, wherein the zero voltage switching unit comprises a MOS transistor or a bipolar junction transistor.

4. The input voltage transfer apparatus according to claim 1, wherein the nonzero voltage switching unit comprises a MOS transistor or a bipolar junction transistor.

5. The input voltage transfer apparatus according to claim 1, further comprising a reverse-current prevention unit preventing a current from being reversely applied to the zero voltage switching unit.

6. The input voltage transfer apparatus according to claim 5, wherein the reverse-current prevention unit comprises a diode.

7. The input voltage transfer apparatus according to claim 1, further comprising an auxiliary storage unit storing the source voltage which is transferred thereto while the zero voltage is being inputted.

8. The input voltage transfer apparatus according to claim 7, wherein the auxiliary storage unit comprises a second capacitor.

9. An input voltage transfer apparatus for a Light Emitting Diode (LED) lighting system, the input voltage transfer apparatus comprising:

a source voltage storage unit storing a source voltage;

a zero voltage switching unit turning on according to the source voltage stored in the source voltage storage unit when a zero voltage is inputted;

a shutdown signal supply unit receiving the source voltage to supply a shutdown signal for shutting down a control circuit, when the zero voltage is inputted thereto; and a nonzero voltage switching unit turning on according to a current applied thereto through the zero voltage switching unit when a nonzero voltage is inputted, wherein when the nonzero voltage switching unit is turned on, the shutdown signal supply unit is turned off, and the source voltage storage unit discharges the stored source voltage.

10. The input voltage transfer apparatus according to claim 9, wherein the source voltage storage unit comprises a first resistor and a first capacitor.

11. The input voltage transfer apparatus according to claim 9, wherein the zero voltage switching unit comprises a MOS transistor or a bipolar junction transistor.

12. The input voltage transfer apparatus according to claim 9, wherein the nonzero voltage switching unit comprises a MOS transistor or a bipolar junction transistor.

13. The input voltage transfer apparatus according to claim 9, wherein the shutdown signal supply unit comprises a PMOS transistor or a PNP bipolar junction transistor.

14. The input voltage transfer apparatus according to claim 13, wherein the shutdown signal supply unit further comprises a Zener diode connected between a base of the PNP bipolar junction transistor and a ground.

15. The input voltage transfer apparatus according to claim 9, further comprising a reverse-current prevention unit preventing a current from being reversely applied to the zero voltage switching unit.

16. The input voltage transfer apparatus according to claim 15, wherein the reverse-current prevention unit comprises a diode.

17. The input voltage transfer apparatus according to claim 9, further comprising an auxiliary storage unit storing the source voltage which is transferred thereto while the zero voltage is being inputted.

18. The input voltage transfer apparatus according to claim 17, wherein the auxiliary storage unit comprises a second capacitor.

19. The input voltage transfer apparatus according to claim 2, wherein the zero voltage switching unit is turned on during a time constant of the first resistor and the first capacitor.

20. The input voltage transfer apparatus according to claim 9, wherein the shutdown signal supply unit comprises a NMOS transistor or a NPN bipolar junction transistor, and wherein the shutdown signal supply unit further comprises a Zener diode connected between abase of the NPN bipolar junction transistor and the source voltage storage unit.

* * * * *